United States Patent [19]

Bergstrom

[11] 4,047,337

[45] Sept. 13, 1977

[54] SOUND INSULATING PANELS

[75] Inventor: Torsten Bergstrom, Barseback, Sweden

[73] Assignee: Formac International AB, Arlov, Sweden

[21] Appl. No.: 715,522

[22] Filed: Aug. 18, 1976

[30] Foreign Application Priority Data

Oct. 30, 1975 Canada ..... 238682

[51] Int. Cl.[2] ..... A47G 5/00; E04B 1/86

[52] U.S. Cl. ..... 52/71; 24/204; 52/145; 160/135; 181/287

[58] Field of Search ..... 52/145, 71, 144, 239; 181/336; 24/204; 160/135, 351

[56] References Cited

U.S. PATENT DOCUMENTS

| | | | |
|---|---|---|---|
| 3,147,528 | 9/1964 | Erb | 24/204 |
| 3,312,025 | 4/1967 | Deakins | 52/239 |
| 3,328,086 | 6/1967 | Johnston | 181/33 G |
| 3,559,352 | 2/1971 | Magnuson | 52/239 |
| 3,571,999 | 3/1971 | Downing | 52/483 |
| 3,592,288 | 7/1971 | Walter | 181/33 G |
| 3,871,153 | 3/1975 | Birum | 52/239 X |
| 3,948,347 | 4/1976 | Rutledge | 52/145 |
| 3,949,827 | 4/1976 | Witherspoon | 181/33 G |

FOREIGN PATENT DOCUMENTS

| | | | |
|---|---|---|---|
| 371,740 | 12/1974 | Sweden | 52/71 |

*Primary Examiner*—J. Karl Bell

[57] ABSTRACT

A sound insulating panel having improved sound absorption properties. Known sound insulating panels are of sandwich-type construction, requiring several manufacturing steps which are both time-consuming and expensive. Additionally, partitions can be formed from panels according to the present invention which require neither special skills nor additional tools when erecting or dismantling the partitions. According to the present invention, there is provided an improved sound insulating panel having a pair of opposed major surfaces extending between a pair of opposite vertical edges. One of a pair of complementary tapes are mounted on at least one of the vertical edges of the panel. The tape is adapted to releasably engage a second complementary tape located on a second structure, such that the two tapes form a sound absorbing connection between the panel and second structure. The panel has a sound insulating core which, together with the sound absorbing connection, minimizes sound transmission through and around the panel past the sound absorbing connection.

5 Claims, 4 Drawing Figures

SOUND INSULATING PANELS

BACKGROUND OF THE INVENTION

1. Field of the Invention

The present invention relates generally to panels which can be connected together to form partitions and, in particular, to such panels having improved sound absorption properties.

2. Description of the Prior Art

Known panels which have been used to form interior space dividers, such as in office landscaping, have required the use of common supporting posts, or similar structures, by means of which adjacent panels are connected together. Thus, the panels themselves are not self-supporting until connected to the common supporting post, rendering assembly of such panels more difficult. Additionally, utilization of common supporting posts requires the use of fasteners, such as screws or bolts, and frequently the use of mounting brackets. As such, mounting of these panels frequently necessitates the use of special tools, as well as special skills on the part of the persons erecting the panels. Further, the use of separate mounting brackets detracts from the aesthetic appearance of the partitions formed in this manner.

Panels of the type referred to above which have been provided with sound-absorbing properties, such as disclosed in Canadian Pat. No. 912,982, are of sandwich-type construction. As such, these panels require several manufacturing steps in order to construct the panel, rendering fabrication thereof both time-consuming and expensive. Additionally, special boarding is required adjacent the flat surfaces of a panel in order to provide the necessary structural strength therefor.

The present invention proposes to provide an improved sound insulating panel which requires neither special skills nor additional tools to erect the panels when forming partitions, or when rearranging panels of existing partitions. Prior to connecting adjacent panels together, the panels themselves are self-supporting. The panels are not provided with mounting brackets, or similar hardware, to detract from the appearance of the panels. Further, the panels according to the present invention do not require the use of common supporting posts, or similar structures, between adjacent panels.

As such, the connecting of the panels together can be performed quickly so as to form partitions which are both aesthetically pleasing in appearance, and more versatile than similar panels.

The hinge formed between adjacent panels can be so constructed as to permit the angle between adjacent screens to be varied to any desired position. Further, by providing a positive connection between adjacent panels over the height of the vertical edges thereof, improved sound absorption properties are achieved by limiting sound transmission between adjacent panels.

SUMMARY OF THE INVENTION

According to the present invention, there is provided an improved sound insulating panel having a pair of opposed major surfaces extending between a pair of opposite vertical edges. One of a pair of complementary tapes are mounted on at least one of the vertical edges of the panel. The tape is adapted to releasably engage a second complementary tape located on a second structure, such that the two tapes form a sound absorbing connection between the panel and second structure.

The panel has a sound insulating core which, together with the sound absorbing connection, minimizes sound transmission through and around the panel past the sound absorbing connection.

BRIEF DESCRIPTION OF THE DRAWINGS

In drawings which illustrate embodiments of the present invention.

DESCRIPTION OF THE PREFERRED EMBODIMENTS

Figure 1:
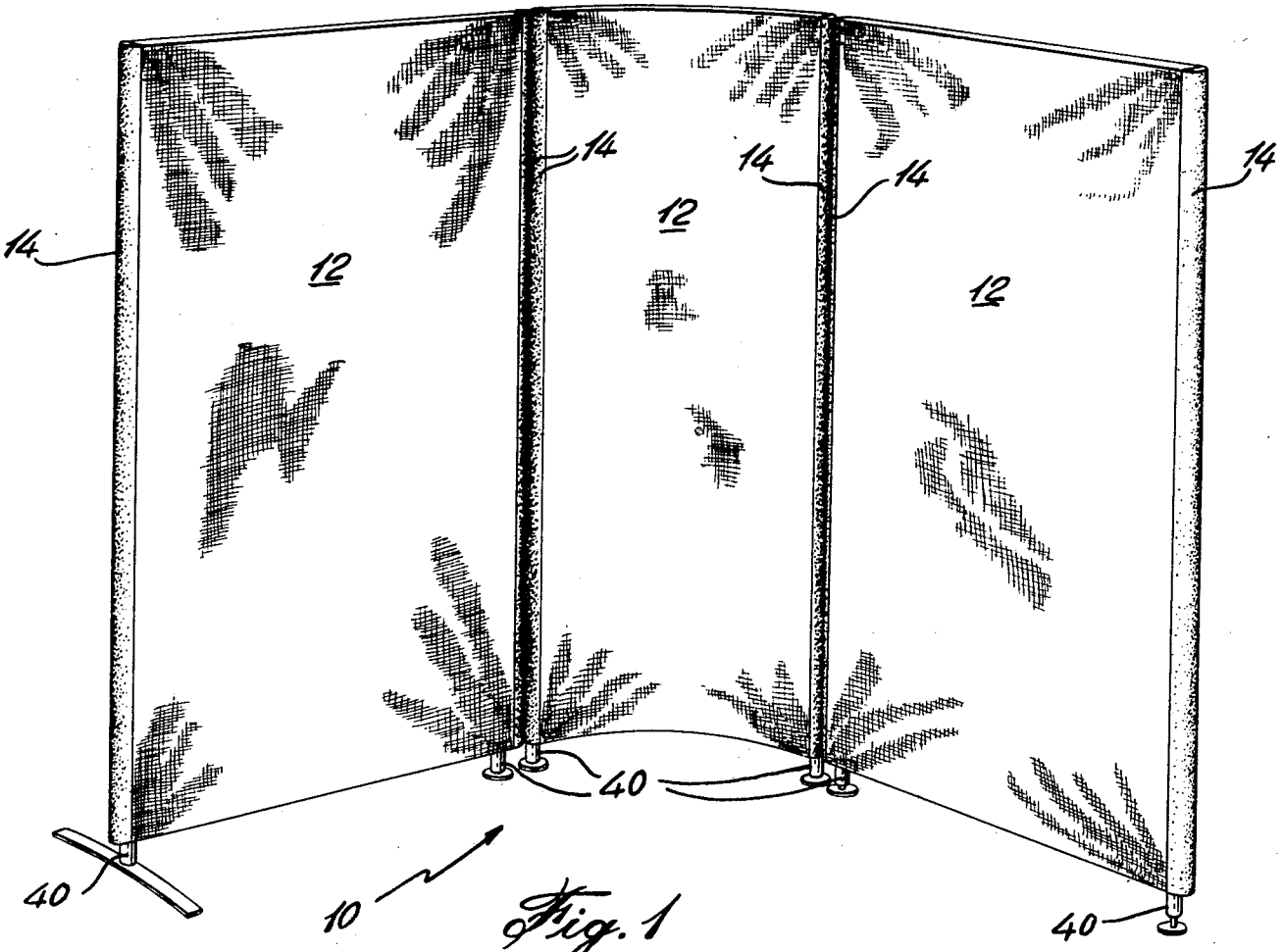
FIG. 1 is a perspective view of a partition formed from panels according to the present invention.

As seen in FIG. 1, the partition indicated by reference numeral 10 comprises three sound insulating panels 12 constructed according to the present invention. Each of the panels 12 includes a pair of opposite vertical edges 14 which are rounded in plan view, as seen in FIG. 2, each vertical edge supporting one of a pair of complementary tapes 16, 16', the complementary tapes adapted to be pressed together in order to form a hinge connection between adjacent panels.

The hinge formed from a pair of complementary tapes, 16, 16' extends the height of the vertical edges 14 of the panels 12 and provides a continuous positive connection between the adjacent panels at this location. The rounded vertical edges 14 permit adjustment of the angle between adjacent panels 12 by rolling one of the vertical edges 14 over the rounded surface of the vertical edge of the adjacent panel. In this way, any number of positions of the adjacent panels can be obtained without disconnecting the hinge formed by the complementary tapes 16, 16', thereby permitting quick and easy rearrangement of partitions formed from panels 12. Likewise, by providing such a hinged connection between the panels, it is unnecessary to utilize tools, nor does it require special skills, in order to connect the panels together so as to form partitions, or to rearrange or dismantle existing partitions. Further, the use of the tapes 16, 16', eliminates the necessity of providing supporting posts between adjacent panels as well as the use of fasteners and additional brackets to connect adjacent panels together. As a result, a panel construction is provided which can be readily assembled and disassembled by most anyone to form or dismantle partitions.

By providing complementary tapes 16, 16', which extend the height of the vertical edges 14 of the panels 12, a hinged connection is provided between the panels which limits the transfer of sound therebetween. In this way, the hinged connection assists in minimizing sound transfer between the panels.

Figure 2:
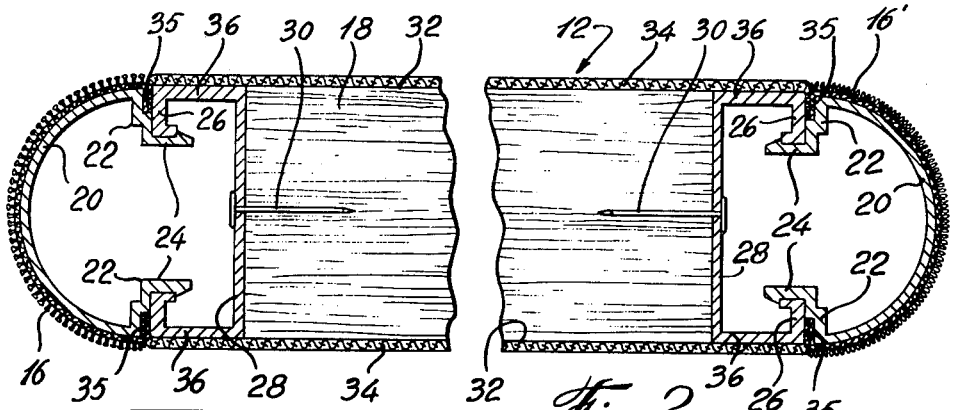
FIG. 2 is a horizontal cross-section taken through a panel according to the present invention.

In order to minimize sound transfer through the panels 12, a panel core 18, best seen in FIG. 2, is fabricated from sound insulating and sound absorbing material. In particular, it has been found that a glass wool sheet glued with twelve to fourteen percent glue and having a density equal to or greater than 90 kilograms per cubic meter has been found to provide exceptional properties with respect to minimizing the transmission of sound through the panels.

As can further be seen from FIG. 2, the vertical edges of the panels are formed from extruded aluminum profiles 20 having an approximately semi-cylindrical outer surface which supports a respective complementary tape 16, 16'. The profile 20 includes inwardly-directed flanges 22 which terminate in rearwardly extending gripping means 24, the gripping means adapted to engage cooperating bent portions 26 located on channel-like frame members 28. The core 18 extends between the frame members 28 and is supported in position by means of fasteners 30 comprising tacks or nails. Other means of securing the core 18 in position within the frame structure can be utilized within the scope of the present invention.

The profiles 20 have a radius of curvature which is greater than 15 mm and less than 35 mm in order to provide an effective hinged connection between complementary tapes 16, 16', situated on the rounded profiles 20. The preferred range of the radius of curvature is between 20 mm and 30 mm. The height of the profiles 20 supporting the complementary tapes 16, 16', should be at least 800 mm in order to provide sufficient gripping surface for the tapes, thereby providing a hinged connection which will not become accidently separated.

The core 18 has smooth major surfaces 32 in order to provide a suitable backing surface for fabric 34 which extends over the major surfaces 32 of the panel 12. The thickness of the core 18 is such as to correspond as closely as possible to the width of the channel-like frame members 28, thereby eliminating the existence of any shoulders adjacent the ends of the panels which would otherwise detract from the appearance of the panels. The fabric 34 is stretched over the major surfaces 32 of the panel, with ends of the fabric 34 being forced over flanges 36 of the members 28 and being glued thereto. The profiles 20 are snapped into position after securing of the ends of the fabric 34 to the channel-like frame members 28, there being shoulder portions 35 on the flanges 22 of the profile 20 to accommodate the ends of the fabric 34. In this way, the ends of the fabric are concealed from sight, thereby improving the aesthetic appearance to the panel, as well as preventing accidental removal of the fabric from the panel.

The complementary tapes 16, 16', are so constructed that one of the complementary tapes, tape 16 in FIG. 2, is provided with mushroom-shaped projections which engage meshes on complementary tape 16' situated on the adjacent panel 12. The two complementary tapes 16, 16', form a tape fastener which has been found to provide an excellent hinged connection between adjacent panels. As well, the hook-type of tape fastener is limited in the width in which strips thereof are sold commercially, the largest width being approximately 44 mm. Since the minimum radius of curvature of the profile 20 has been found to be 15 mm, corresponding to a surface circumference of 45 mm, the hook type of tape fastener has, to date, not been found to be useful for this particular application. If the hook-type tape fastener were available in suitable widths, its possible use could be reconsidered. On the other hand, the mushroom-type of tape fastener is available in any width and can thus be obtained in sufficient widths to cover the limits of the radius of curvature of the profiles 20.

Each of the panels 12 is supported by a pair of legs 40 which are adjustable to permit variation in the elevation of the ends of the panels, thereby permitting alignment of the complementary tapes 16, 16', situated on the vertical edges 14 of two adjacent panels 12. The construction of the legs 40 is best illustrated in FIGS. 3 and 4.

Figure 3:
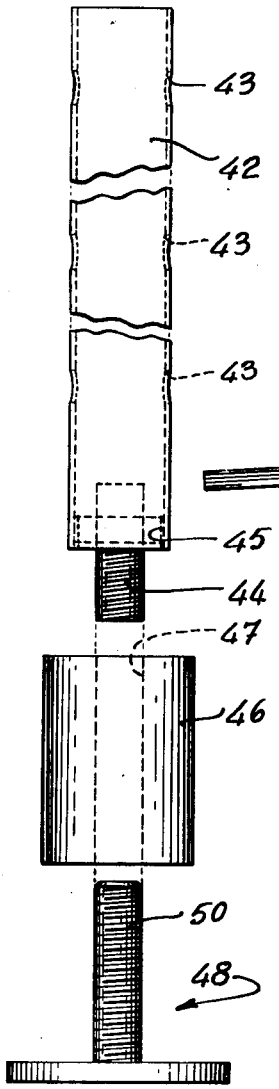
FIG. 3 is an exploded view illustrating one embodiment of the leg and frame components of the panels.

In FIG. 3, a tubular frame element 42 extends along the interior of the panel 12 in the space defined between the profiles 20 and frame members 28. The frame element 42 is secured in position to the panel by means of fasteners which are inserted through openings 43 in the frame element, the fasteners engaging cooperating openings in channel-like frame members 28. The lower end of frame element 42 is fitted with a threaded stud 44 secured to a collar 45, the collar 45 being rigidly connected to the frame element 42 adjacent the lower end thereof by welding or by means of suitable fasteners. The lower end of the stud 44 extends beneath the lower surface of the frame element 42. A second collar 46 having a threaded opening 47 extending therethrough is adapted to be screwed onto the lower end of stud 44. A foot pedestal 48 having a threaded stud 50 extending upwardly therefrom is screwed into the lower end of the threaded collar 46, with the elevation of the end of the panel 20 being adjustable by varying the distance which the stud 50 of the pedestal 48 is screwed into the collar 46.

Figure 4:
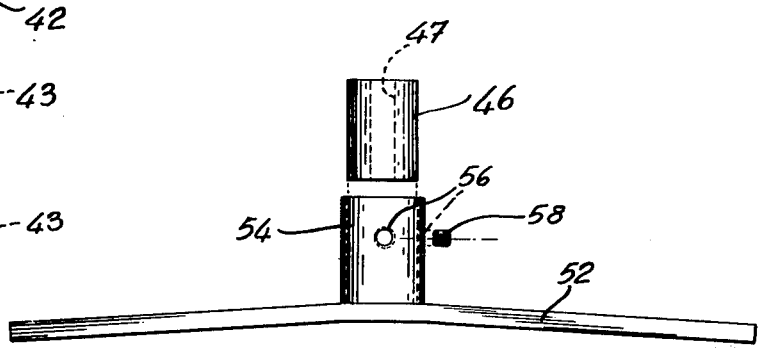
FIG. 4 is a further embodiment of the construction of the leg and frame components of the panels.

The foot pedestal 48 can be replaced by an elongated base member 52, best seen in FIG. 4. The base member 52 comprises a plate portion which extends outwardly on either side of an upstanding collar 54, the collar 54 having an inside diameter which permits the collar 54 to fit over the outer surface of the threaded collar 46. The collar 54 is provided with threaded openings 56 through which set screws 58 can be inserted in order to secure the base member 52 in position relative to the threaded collar 46. The set screws 58 engage the outer surface of the threaded collar 46, thereby retaining the base members in position. The pedestals 48 can be utilized in locations where it is not desired to use base members 52, the latter tending to interfere with pedestrial traffic around the partitions formed by the panels, as well as being more expensive to manufacture.

It is also within the scope of the present invention to connect a panel 12 to a wall, bookcase, or a piece of furniture, the latter being provided with a complementary tape for forming a hinged construction with the panel. As a result it is only necessary that the hinged connection be made up of one complementary tape situated on a rounded surface to permit variation of the angle between adjacent panels. On the other hand, in situations where there is no need to vary the angle between panels, the rounded profiles 20 can be replaced with flat vertical edges supporting complementary tapes 16, 16'. This latter construction would still provide a sound-absorbing partition construction which would, however, lack the versatility of partition constructions having rounded vertical edges, such as illustrated in FIG. 1.

I claim:

1. An improved sound insulating panel assembly having a sound insulating core defining a pair of opposed major surfaces extending between a pair of opposite vertical edges, each vertical edge having a channel-like frame member extending along the height thereof, an extruded profile having a semi-cylinderical outer surface releasably supported in each respective channel-like frame member, the semi-cylinderical outer surface having a radius of curvature between 15 and 35 mm, and the profile having a height of at least 800 mm, each extruded profile having a pair of inwardly directed flanges which terminate in rearwardly extending gripping means, cooperating bent portions on the channel-like frame members engaging the gripping means, the width of the insulating core being substantially equal to the corresponding dimension of the channel-like frame members; fabric stretched over the major surfaces of the panels, forced over the flanges of the frame members and adhesively secured thereto, the inwardly directed flanges of the profiles having shoulder portions accomodating ends of the fabric between the shoulder and adjacent surfaces of the channel-like frame members and concealing ends of the fabric from view while preventing accidental removal thereof from the panel; and meshingly-engagable, connecting-tapes mounted on the respective outer radiused surface of said profiles, said connecting-tapes being releasably-engagable with a complementary connecting-tape on a second structure for assembling the sound insulating panel and said second structure, the two connected tapes at said profile defining a sound-absorbing connection between the panel and said second structure and minimizing sound transmission therebetween, the core being secured to the frame members by fastening means, each pair of complimentary tapes respectively including releasably-engagable mushroom-like sections and meshing portions.

2. A sound insulating panel assembly according to claim 1, wherein a tubular member extends partially along the height of the panel between the panel and the adjacent profile, fastener means securing the tubular members to the frame members, a member-supporting threaded stud secured to the tubular member adjacent the lower end thereof with a portion of the threaded stud exposed beneath the lower end of the tubular member; a threaded element adjustably-connected on the exposed portion of the threaded stud; and an adjustable leg structure, adjustably mounted on said threaded element and supporting the panel in position for permitting elevational adjustments of each end of the panel for alignment of complimentary connecting-tapes on vertical edges of the panel.

3. A sound insulating panel assembly according to claim 2, wherein the adjustable leg structure comprises a pedestal having an upwardly extending threaded stud engaged in a threaded opening in the threaded element.

4. A sound insulating panel assembly according to claim 2, wherein the adjustable leg structure comprises an elongated base member with an upstanding collar, the collar telescopically receiving the threaded element, said collar having at least one transverse, threaded opening, each threaded opening having a set screw therein and releasably engaging the outer surface of the threaded element received in said collar for assembling the elongated base member on said panel assembly.

5. A sound insulating panel according to claim 1, wherein the panel includes a core of sound insulating material comprising glass wool sheet and from 12 to 14 percent glue and having a density of at least 90 kilograms per cubic meter.

* * * * *

UNITED STATES PATENT AND TRADEMARK OFFICE

CERTIFICATE OF CORRECTION

PATENT NO. : 4,047,337

DATED : September 13, 1977

INVENTOR(S) : Torsten Bergstrom

It is certified that error appears in the above-identified patent and that said Letters Patent are hereby corrected as shown below:

[73] Assignee: Formfac International AB, Arlov, Sweden

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*